US005522096A

United States Patent [19]

Brown

[11] Patent Number: 5,522,096

[45] Date of Patent: Jun. 4, 1996

[54] TOILET TANK HAND WASH BASIN

[76] Inventor: Carlton D. Brown, 1540 N. Benton Way, Los Angeles, Calif. 90026

[21] Appl. No.: 289,557

[22] Filed: Aug. 12, 1994

[51] Int. Cl.[6] ..... A47K 4/00; E03C 1/01

[52] U.S. Cl. ..... 4/665; 4/340; 4/353

[58] Field of Search ..... 4/213, 340, 341, 4/342, 353, 664, 665; 277/178; 220/356, 357, 358

[56] References Cited

U.S. PATENT DOCUMENTS

| | | | |
|---|---|---|---|
| 1,697,814 | 1/1929 | Forbes | 277/178 X |
| 1,935,779 | 11/1933 | Kemach | 4/665 |
| 2,772,931 | 12/1956 | Biedermann | 277/178 X |
| 3,090,965 | 5/1963 | Panza | 4/353 |
| 3,428,964 | 2/1969 | Lucas | 4/665 |
| 3,588,922 | 6/1971 | Carfora | 4/665 |
| 3,860,972 | 1/1975 | Costello | 4/353 X |
| 5,228,152 | 7/1993 | Fraley | 4/665 X |
| 5,341,529 | 8/1994 | Serrano | 4/665 |

FOREIGN PATENT DOCUMENTS

| | | | |
|---|---|---|---|
| 3537798 | 4/1987 | Germany | 4/665 |
| 4003284 | 8/1991 | Germany | 4/665 |
| 8701376 | 1/1989 | Netherlands | 4/664 |
| 2087943 | 6/1982 | United Kingdom | 4/665 |

*Primary Examiner*—Robert M. Fetsuga
*Attorney, Agent, or Firm*—Joseph H. McGlynn

[57] ABSTRACT

A finger wash basin that can be attached to an existing toilet without major modifications. The basin consists of a container which is mounted adjacent or on the existing toilet and has a water supply pipe which is connected to the existing water supply pipe for the toilet bowl. The container also has a drain pipe which leads used water back to the toilet bowl. A gasket is attached to the top of the toilet tank and has a top surface which will securely mount the toilet tank lid. The gasket can be provided with openings that will allow the water supply pipe and the drain pipe to pass through the gasket between the top of the toilet tank and the toilet tank lid.

5 Claims, 1 Drawing Sheet

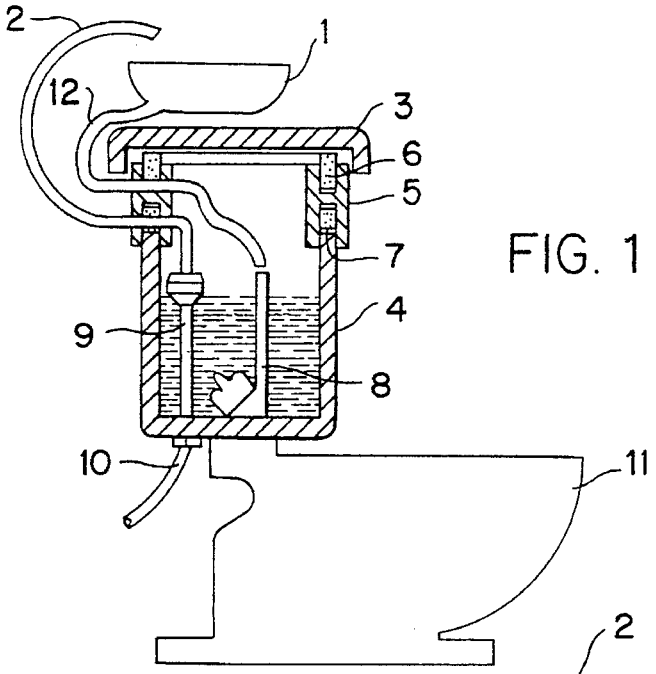
FIG. 1
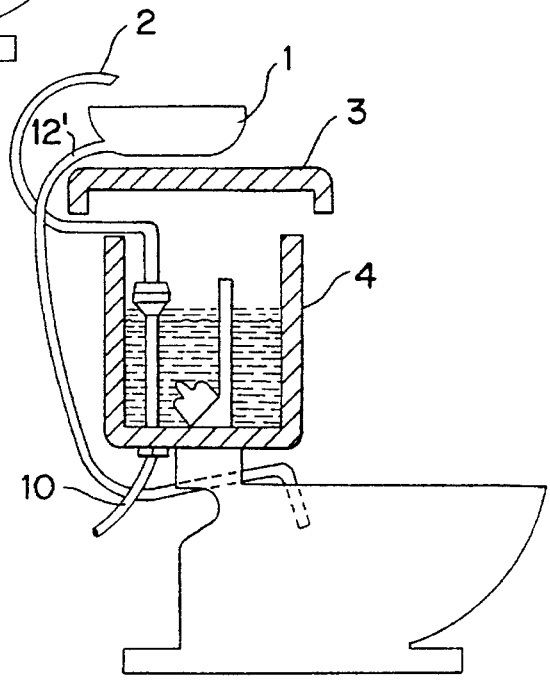
FIG. 2
FIG. 3
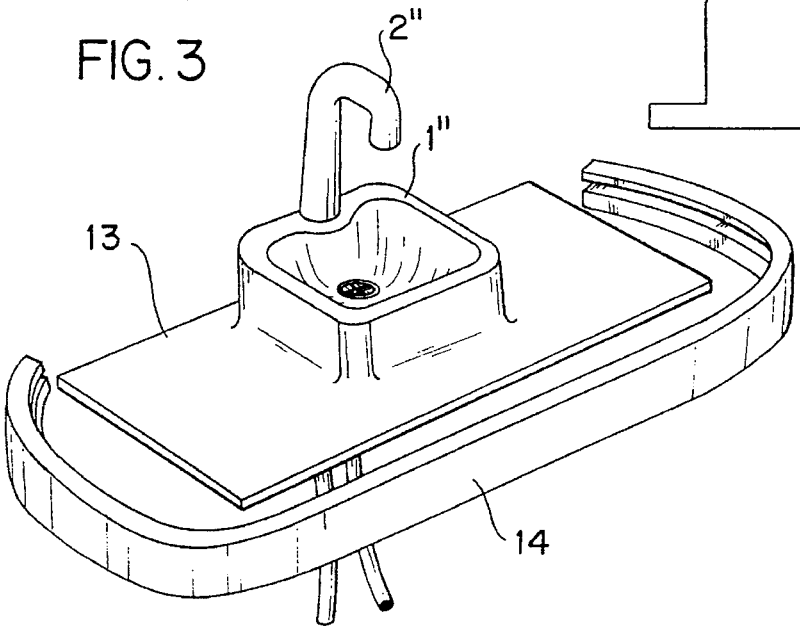
FIG. 4
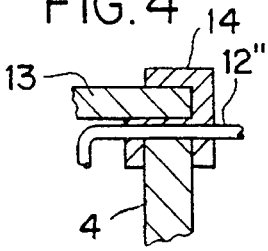

TOILET TANK HAND WASH BASIN

BACKGROUND OF THE INVENTION

1. Field of the Invention

This invention relates generally to a fixture for a toilet, and more particularly to a hand wash basin which is attached to a standard toilet.

2. Description of the Prior Art

Other hand wash basins and toilet combinations are known in the prior art, however, all of the previous combinations either use separate water pipes that must be attached to the basin, or use a special tank top. For example, the prior art patents to Carfora (U.S. Pat. No. 3,588,922) and Kermach (U.S. Pat. No. 1,935,779) both require water pipes installed in the wall behind the toilet and separate faucets attached to the pipes. This requires additional expense when the fixtures are installed, and additional expense to maintain the fixtures. The prior art patents to Fraley (U.S. Pat. No. 5,228,152) and Lucas (U.S. Pat. No. 3,428,964) do not require separate pipes, but do require either a special tank top, as in Fraley, or a special toilet tank as in Lucas. This, of course, means additional expense, since these items are not standard fixtures. Also, all of the above mentioned disadvantages make it difficult to modify an existing toilet, again, requiring more expense if a hand wash basin is desired.

SUMMARY OF THE INVENTION

The present invention eliminates all the disadvantages of the prior art devices. It uses only water supply pipes that have already been installed and does not require any major modifications to an existing toilet. It requires no special tools to install and does not require the services of a professional plumber. It can be provided as an additional item sold with new toilets or can be sold as a separate item to be added to a toilet that has already been installed.

These and other objects and advantages of the present invention will be fully apparent from the following description, when taken in connection with the annexed drawings.

BRIEF DESCRIPTION OF THE DRAWINGS

FIG. 1 is a cross-sectional view of the standard toilet tank with the hand wash basin installed.

FIG. 2 is a cross-sectional view of the standard toilet tank with a modified form of the hand wash basin installed.

FIG. 3 is another embodiment with the hand wash basin a unitary part of the tank top.

FIG. 4 is a partial view of the gasket or spacer used with the top of FIG. 3.

DESCRIPTION OF THE PREFERRED EMBODIMENT

FIG. 1 shows a standard toilet comprising a bowl 11, a tank 4, and a tank top 3. A water supply line 10 enters through the bottom of the tank and into supply tube 9. Tube 8 is the normal overflow tube placed inside the toilet. It should be noted that conventional toilet attachments such as a water inlet for the tank 4 and a flush actuator have been eliminated from the specification and drawings for purposes of clarity. Basin 1 is attached to a drain line 12 which empties into the overflow tube 8 and from there into the bowl 11. Line 2 is attached to water supply tube 9 refill outlet at one end and at the other end supplies water to the basin

1. Although the tube 2 is shown as a plain tube, it is understood that a faucet may be attached to the tube 2 if desired. An H-shaped gasket or spacer 5 is positioned on the rim of the tank 4. Two other gaskets or spacers 6 and 7 are positioned within the open portions of the H-shaped gasket or spacer. The gasket or spacer 6 forms a ridge to hold the toilet lid 3 firmly and securely. The gaskets or spacers raise the top 3 above the tank 4 and allow the water supply line 2 and the drain line 12 to pass between the tank 4 and the top 3.

In use, when the toilet is flushed, water flows from water supply pipe 10 into water supply tube 9 and then into the basin through line 2. Users may rinse their hands and the used water will drain from the basin 1 through the overflow tube 8 and then into the bowl 11.

The embodiment shown in FIG. 2 (the gasket or spacer is removed for clarity) is essentially the same as the FIG. 1 device except the drain line 12' runs down the outside of the tank 4 and directly into the bowl 11.

It should be noted that where the basin is mounted is not critical. The basins in FIGS. 1 and 2 are shown resting above the top of the toilet, however the basins 1 in both FIGS. 1 and 2 could be mounted directly on the top 3. In either case the toilet tank hand wash basin will operate in the same manner.

FIG. 3 shows the basin 1" made unitary with the top 13. In this embodiment the supply and drain lines can run through the top 13 or they can run through the gasket or spacer 14 in the same way as in the FIG. 1 device. It should be noted that only the drain line 12" is shown in FIG. 4. The gasket or spacer 14, shown in cross-section in FIG. 4, is wrapped around the top 13 to provide a neat appearance and to protect the top 13 and the upper edge of the tank 4. The gasket or spacer 14 is a modified h-shape, with a U-shaped portion on the bottom which will slip over the top rim of the toilet tank. The upper portion of the gasket or spacer includes an L-shaped channel to receive the top 13, as clearly shown in FIG. 4.

Also, the top 13 does not have to be made from the normal materials a toilet top is made from. It can be made from a material that can be cut. This will allow users to cut the top for a custom fit on the toilet.

Other changes may be made by persons of skill in the art without departing from the scope of the invention. For example, it is not necessary to mount the basin on the toilet top. It could be mounted on a wall adjacent the toilet and still be usable with any of the disclosed embodiments.

Although the toilet tank hand wash basin and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A toilet tank hand wash basin for a toilet, said toilet having a tank comprising sides, a bottom and an open top for holding water and a lid for covering said open top of said tank, and a bowl, said hand wash basin comprising:

container means for collecting water, means for supplying water to said container means, means for draining water from said container means, and gasket means adapted to be mounted around a perimeter of said open top for raising said lid above said open top of said tank, said gasket means having an inverted U-shaped portion for receiving an edge of said open top of said tank, and a second U-shaped portion which is a mirror image of said inverted U-shaped portion, said second U-shaped portion having ridge means mounted within said U-shaped portion for securely mounting said lid, and means for allowing at least one of said means for supplying water to said container means and means for draining water from said container means to pass through said gasket means between said lid and said open top of said tank.

2. The toilet tank hand wash basin as claimed in claim 1, wherein said container means is adapted to be mounted above said lid.

3. The toilet tank hand wash basin as claimed in claim 1, wherein both of said means for supplying water to said container means and said means for draining water from said container means pass through said gasket means.

4. The toilet tank hand wash basin as claimed in claim 1, wherein said means for draining water is adapted to run from said container means, outside said tank, and then into said bowl.

5. A toilet tank hand wash basin in combination with a toilet, said toilet having a tank comprising sides, a bottom and an open top for holding water and a lid for covering said open top of said tank, and a bowl, said hand wash basin comprising:

container means for collecting water, said container means, said lid are unitary, means for supplying water to said container means, means for draining water from said container means, and gasket means mounted around a perimeter of said open top for raising said lid above said open top of said tank, said gasket means having an inverted U-shaped portion for receiving an edge of said open top of said tank, and said gasket means having an L-shaped channel means mounted at the closed portion of said inverted U-shaped portion for receiving said lid, and means for allowing at least one of said means for supplying water to said container means and means for draining water from said container means to pass through said gasket means between said lid and said open top of said tank.

* * * * *